US005148143A

United States Patent [19]

Greenstein

[11] Patent Number: 5,148,143

[45] Date of Patent: Sep. 15, 1992

[54] PRECISION THICK FILM ELEMENTS

[75] Inventor: Bernard Greenstein, Glenview, Ill.

[73] Assignee: Beltone Electronics Corporation, Chicago, Ill.

[21] Appl. No.: 710,161

[22] Filed: Jun. 4, 1991

Related U.S. Application Data

[63] Continuation-in-part of Ser. No. 685,453, Apr. 12, 1991.

[51] Int. Cl.[5] ..... H01C 10/10

[52] U.S. Cl. ..... 338/195; 338/185

[58] Field of Search ..... 338/195, 185, 186

[56] References Cited

U.S. PATENT DOCUMENTS

| | | | |
|---|---|---|---|
| 3,717,837 | 2/1973 | MacLachlan | 338/160 |
| 4,329,676 | 5/1982 | McDonald et al. | 338/198 |
| 4,345,236 | 8/1982 | Eichelberger et al. | 338/176 |
| 4,352,084 | 9/1982 | Graves et al. | 338/127 |
| 4,527,041 | 7/1985 | Kai | 219/121 |
| 4,647,899 | 3/1987 | Moy | 338/309 |
| 4,649,366 | 3/1987 | McDonald | 338/134 |
| 4,841,275 | 6/1989 | Murata | 338/195 |
| 5,051,719 | 9/1991 | Gaston et al. | 338/195 X |

*Primary Examiner*—Marvin M. Lateef

*Attorney, Agent, or Firm*—Dressler, Goldsmith, Shore, Sutker & Milnamow, Ltd.

[57] ABSTRACT

A precision thick film resistor has a deposited thick film conducting layer which is adjacent to and in contact with a deposited thick film resistive layer. A laser scribed line, having a width on the order of 2 mils, separates the conductive region into two parts and then extends into the resistive layer. The value of the resistor is set based on the extent that the line extends into the resistive layer. A plurality of thick film conducting elements can be formed by depositing a continuously extending thick film conducting layer on a substrate. Laser scribed lines can be used to isolate various conducting elements in the deposited film from one another. Elements are separated from one another by 2 mil wide laser scribed lines.

11 Claims, 6 Drawing Sheets

Fig. 3
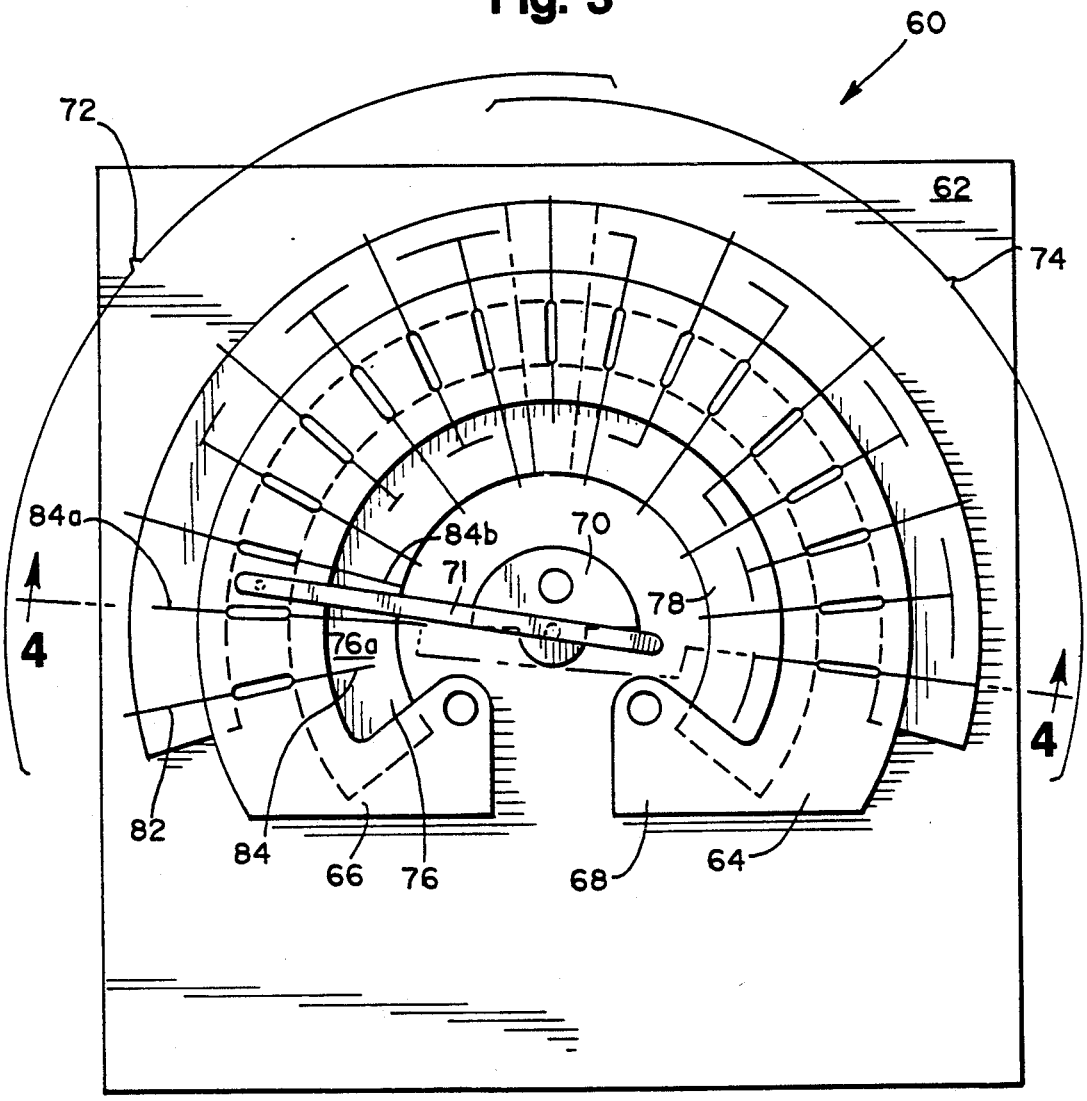
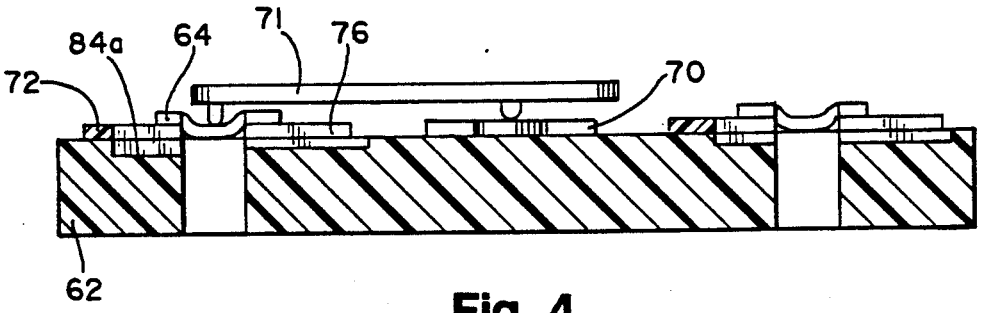
Fig. 4

Fig.11
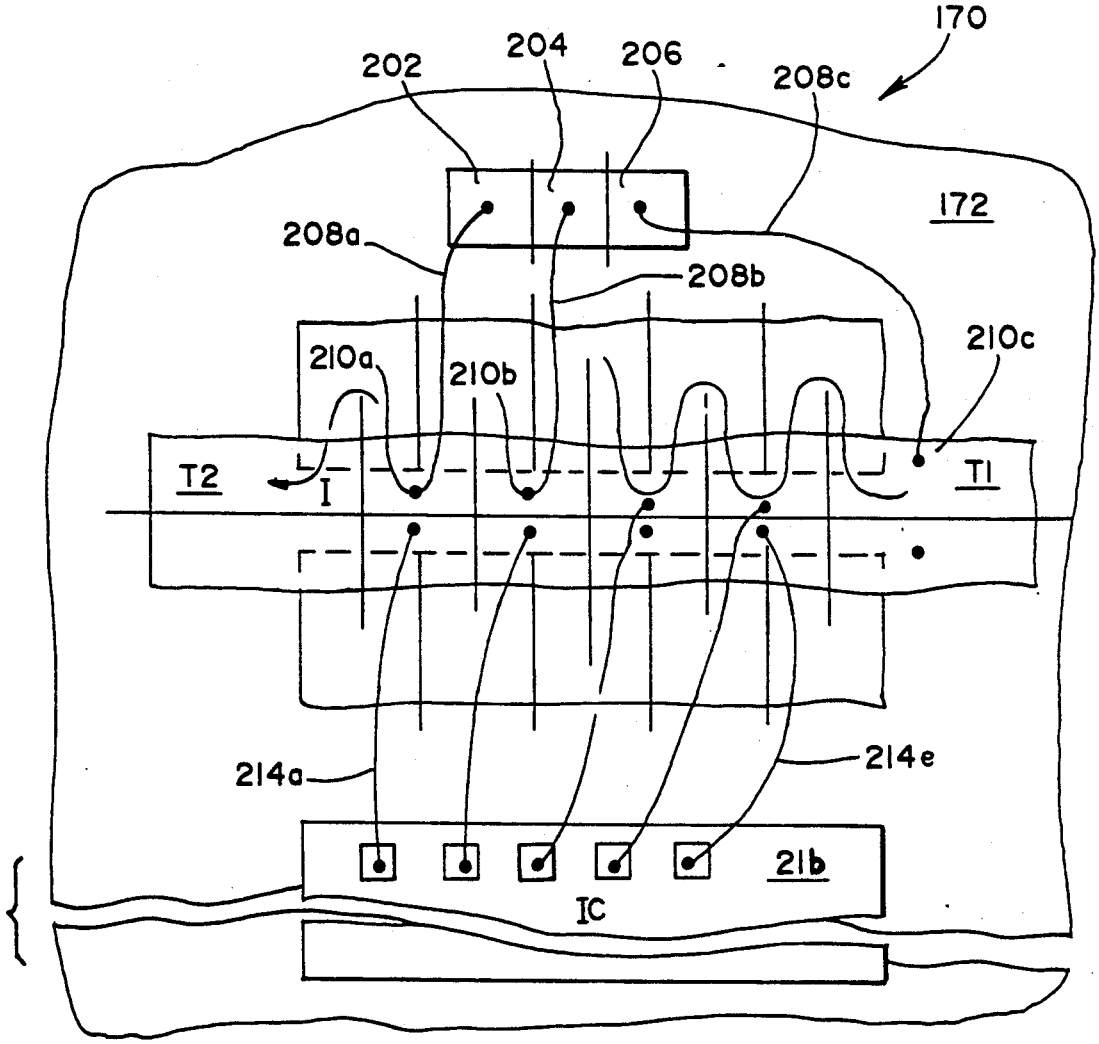
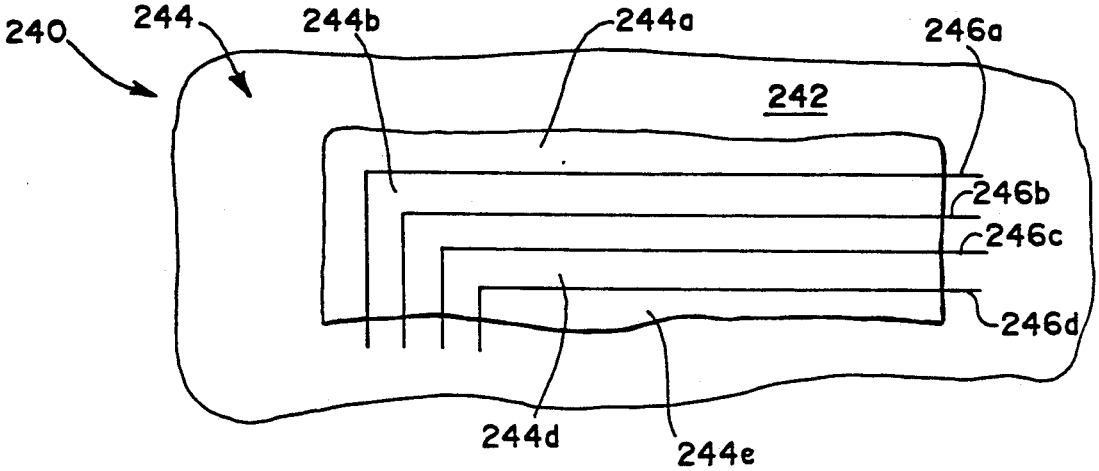
Fig.12

PRECISION THICK FILM ELEMENTS

This is a continuation-in-part of the U.S. patent application Ser. No. 07/685,453 filed Apr. 12, 1991 entitled "Low Noise Precision Resistor".

FIELD OF THE INVENTION

The invention pertains to small, precision electronic elements. More particularly, the invention pertains to miniature, resistive or conductive elements which can be formed of relatively inexpensive thick film deposition processes and extends the use of the thick film printing process by using techniques which allow one to get finer lines and spaces than are inherently possible with the printing process.

BACKGROUND OF THE INVENTION

Prior art resistive elements are known which combine deposited resistive material with deposited conductors which form the electrical leads of the resistor. A precise value of resistance is obtained by scribing a line into the resistive material thereby altering the characteristics of the material between the two leads.

One such structure is disclosed in U.S. Pat. No. 4,647,899 assigned to the assignee of the present invention. In that structure, first and second spaced-apart conductive members are joined by a layer of resistive material. The value of the resistor is determined by a laser scribing process. The resistor structure disclosed in that patent has a relatively complex shape.

In another known resistor structure, a generally rectangular, deposited, resistive layer is terminated at each end by deposited conductive layers. Hence, there exists a non-zero resistance between the two conductive layers.

One or more laser cuts are made in the resistive layer so as to trim the resistor to a predetermined value, that is higher than its initial untrimmed value. A single laser scribed line can be used. Alternately, a plurality of spaced-apart laser scribed lines can be used.

Another known form of such a resistor is known as a "top hat" resistor. It has a shape generally corresponding to the cross-section of a top hat.

In such a resistor, prior to any laser scribing of the resistive material there exists a base resistor value due to the resistive material between the two conductive members which form the contacts for the resistor. As the scribing operation proceeds, and the continuity of the resistive material is interrupted, the value of the resistive element increases from the initial base value.

The initial base value is determined by the configuration of the resistor as well as the resistive characteristic of the deposited material, in ohms per square, as well as the physical spacing between the two conductive elements which is filled with the resistive material.

Thick film deposited resistive elements have heretofore not been available in sizes achievable with thin film technology. One of the limitations of prior art thick film deposition technology has been the amount of space which must be maintained between elements so as to insure electrical separation from one another.

For example, known methods of printing thick film resistors and conductors depend on an ability to print specific line widths and spacings of the conductive and the resistive elements. Typically, 10 mil wide lines and 10 mil spacings between elements are achievable in high production environments.

In some instances, with difficulty, it is possible to get down to the 6–7 mil range. However, this size reduction usually results in lower processing speeds with additional inspection steps needed. Problems encountered at this size include insuring line integrity and insuring that there are no line-to-line shorts. Thus, thick film-type technology has been limited by an inability to achieve better and more reliable lines and spaces therebetween.

It would be desirable therefore to be able to form precision electrical components using relatively inexpensive, available thick film deposition technology with sizes approaching sizes which can be achieved using much more expensive thin film technology. In addition, it would be desirable to be able to form dense, precision resistive elements using relatively imprecise thick film deposition techniques for depositing resistive and conductive layers.

SUMMARY OF THE INVENTION

A miniature variable resistance device exhibits both low noise characteristics and low contact resistance. Various resistance functions can be provided. These include linear, as well as logarithmic.

The device includes an elongated resistive element and a substantially conductive member which extends in contact with the resistive element. Both the resistive element and the conductive element can be deposited using inexpensive, conventional thick film fabrication techniques.

The conductive member is interrupted by a plurality of spaced-apart discontinuities or slots therein. At least some of the discontinuities extend a predetermined amount into adjacent respective portions of the resistive element.

The resistive element can be curved or generally linear in shape. Both the resistive element and the conductive member can be carried on an insulating base. The base can be either planar or curved.

A plurality of resistive values is defined in the resistive element by selectively scribing the resistive element thereby forming non-conductive open regions therein. The scribings are adjacent to members of the plurality of discontinuities.

A particular resistive value can be formed of one or more conductive members separated by pairs of discontinuities and electrically coupled together by portions of the resistive element. The value of an incremental resistive element, located between two spaced apart conductive regions, is determined by the extent to which the adjacent elongated resistive material is scribed thereby altering a resistive path therethrough.

Increasing the total value of resistance in the element involves adding further incremental resistive elements to those which have already been part of the resistive path. Incremental resistance values can also be changed by forming the elongated resistive element from two or more films or layers having different resistivity.

An increased range of resistance values can be achieved by depositing a second elongated resistive element in contact with the conductive member and spaced apart of the initial resistive element. By also scribing the second elongated resistive element, additional conducting paths can be created providing numerous additional incremental resistive elements These elements can then be used, by linking same to other resistive elements in the device, to substantially increase the range of resistance provided within the device.

The resistive elements can be deposited on an insulating substrate using any conventional process. Both thick and thin film deposition methods can be used. Additionally, thick film resistive elements can be printed onto the substrate using conventional thick film techniques and fired thereon to form a physically stable structure.

In the above-described resistance device contact to a variable wiper is made on the conductive material not on any of the resistive material. As a result, there are no limitations as to the resistance values of these devices. Because the wiper is in contact with the conductive member, the device exhibits both a low contact noise and low contact resistance.

Since the incremental resistance values are set by scribing or by laser trimming, the deposited layer of resistance material need not be a high quality deposition which relies for resistance values on controlled physical geometry. Hence, very precise incremental resistance segments, on the order of plus or minus 1% of nominal or less, can be achieved using relatively inexpensive thick film printing techniques.

The device can be mounted in a housing and a linearly movable or rotatable knob can be associated with the wiper element for the purpose of manually altering the resistance value between one end of the device and the movable contact. The assembled device can then be soldered or otherwise attached to a printed circuit board and related circuitry.

Since the resistive material can be applied using a printing process, it is very easy to make any desired shape. On the other hand, since the precision resistance values are achieved by laser trimming in a continuously extending resistive member, unlike the prior art, it is unnecessary to precisely control the geometry of a plurality of discrete film resistors. It is a further advantage of a device as described above that the precise incremental resistor values are achieved relatively independently of printing and/or deposition variations since laser trimming is used to achieve the desired values.

Another advantage of a resistive element as described above is that probes used for measuring the incremental resistance values during the laser trimming process are located at the ends of the conductive member and are not located adjacent to the resistance element that is being trimmed. Hence, larger probe contact end regions can be provided than are present between resistance elements. In addition, the probes need not be moved during the trimming operation.

A method of producing different resistance values between first and second contact regions includes the steps of providing an elongated conductive element, and providing an elongated substantially continuous resistive element in contact with portions of the conductive element.

A particular resistance value is determined between a first and a second contact region by a path which extends therebetween and which includes part of the conductive element and part of the continuous resistive element. A second, higher resistance value, can be achieved by selecting a longer path between the first region and another region displaced from the second region. This path will include portions of the conductive element and a longer part of the continuous resistor element in accordance with the higher desired resistance value.

Further, in accordance with the present invention, a precision electronic component and method of making same are provided The component is formed by depositing a layer of material having predetermined electric characteristics onto an insulating substrate. A laser is used to scribe 2 mil non-conducting lines into the layer thereby precisely defining the characteristics of the component. The laser scribe width can be varied by a mil or two if the need arises.

A precision resistor can be formed by depositing continuously extending layers of conductive and resistive material on the substrate. The layers overlap one another in part.

Starting from a non-overlapping edge of the conductive layer, a laser scribed line cuts the conductive region into two parts joined by the resistive layer. The line is extended into the resistive layer thereby precisely setting the value of resistance between the two conductive regions.

The resistance value starts from a value substantially equal to zero and can then be increased to a maximum based on the characteristics of the resistive material and the size of the deposited region. Several such resistors can be coupled together in series or parallel to provide total resistance values based on composite characteristics.

Two or more different types of resistive materials can be deposited in combination with a single conducting layer. The use of a resistive material with a relatively low value of ohms/square in combination with a resistive material that has a higher value of ohms/square results in a composite multi-resistance element with a broader range of values than that achieved with a single type of resistance material.

In yet another embodiment of the present invention, a plurality of conductive elements can be formed. A layer of conductive material is deposited or printed using a conventional thick film deposition process. The various conductive elements can be separated from one another by one or more 2 mil laser scribed lines.

The resultant structure, a plurality of spaced apart conductive elements can be manufactured using relatively inexpensive thick film process. However, the achieved 2 mil spacings can not cost-effectively be achieved using thick film printing technology.

Similarly, resistive elements embodying the present invention can be packed together with 2 mil spacings not readily achievable solely with thick film printing technology. Yet, the basic resistive elements have been formed using deposited thick film layers.

This result has been achieved in accordance with the present invention, by using one technology to deposit the layer or layers forming the elements and another to isolate elements from one another using 2 mil spacing. Thus, the results achievable with thick film deposition technology can be significantly extended using laser based optical scribing.

Typical resistor sizes on the order of 25 mils $\times$ 10 mils can be readily achieved with 2 mil spacing between resistors. Similarly, a plurality of conductors of various sizes and shapes can be formed with 2 mil spacing therebetween.

A further advantage of the present invention is that a very small, simple, resistor shape saves substrate area for other elements. Another important advantage of the present invention is the extent of the trim range. It is therefore possible to print one resistor paste and achieve a desired resistance range when in the prior art two pastes might have been needed.

For example, if a prior design included 100, 300, and 800Ω values of different configurations and a new design required in addition a 1600Ω value, the same configuration, using the present invention, could be used for all four resistors merely by varying the length of the laser scribed line.

Furthermore, since the range is so large for the trim, the resistivity of the fired paste can vary over a much higher range and still produce acceptable depositions (less process control required).

Lastly, the terminations of the resistors are separated by 0.002", something that cannot be approached by thick film printed techniques. All the above is achieved by a very small simple resistor design taking up very little space, and a very large resistance trim range (more resistance values with one paste).

Resistor terminal separations of 0.002" can be achieved with a single simple straight laser cut. This is therefore a tremendous advantage over a standard resistor design which is considerably larger, more complex in shape, requires a laser cut which is sometimes more complex than a straight cut. Note, in the above, all is achieved without any more processing steps than conventional technology.

It would be possible, alternately, to use the laser as a tool to etch out complete patterns. However, by judiciously designing a resistor/conductor printed pattern in accordance with the present invention, using easily printable 10 mil lines and 10 mil spaces with readily available laser trimming it is possible to:

A) Produce resistor structures with terminal pad spacings of 0.002".

B) Produce a very small resistor element, smaller than conventional with a resistance range a factor of 20 or more.

C) Make trim lines a single linear plunge.

D) Make all resistor sizes the same. To get an extra range, one could make them longer.

E) Make more resistor values for a single paste material.

In addition, taking advantage of the small size, the whole electronic package can be built smaller. Resistors can be strung in series or in parallel with spacing between resistors/resistors, resistors/conductors, conductors/conductors on the order of 0.002" with only a few extra laser trims.

Pad sizes can be made as small as possible, and where needed, can be made bigger, utilizing space saved from the fine spacing. With just a few extra laser cuts, two conductors can extend between 0.010" spaces where none can go with standard printed technology. Finally, as a result of the present invention, it is becoming possible to approach thin film technology sizes and accuracy levels with the advantages of thick film technology.

Numerous other advantages and features of the present invention will become readily apparent from the following detailed description of the invention and the embodiments thereof, from the claims and from the accompanying drawings in which the details of the invention are fully and completely disclosed as a part of this specification.

BRIEF DESCRIPTION OF THE DRAWING

FIG. 3 is a top plan view of an alternate non-linear resistive element;

FIG. 4 is a sectional view taken along plane 4—4 of FIG. 3;

FIG. 11 is a top plan view of an alternate embodiment of a plurality of resistors interconnected in accordance with the present invention;

FIG. 12 is a top plan view of an alternate conductive element in accordance with the present invention;

DETAILED DESCRIPTION OF THE PREFERRED EMBODIMENTS

Figure 1:
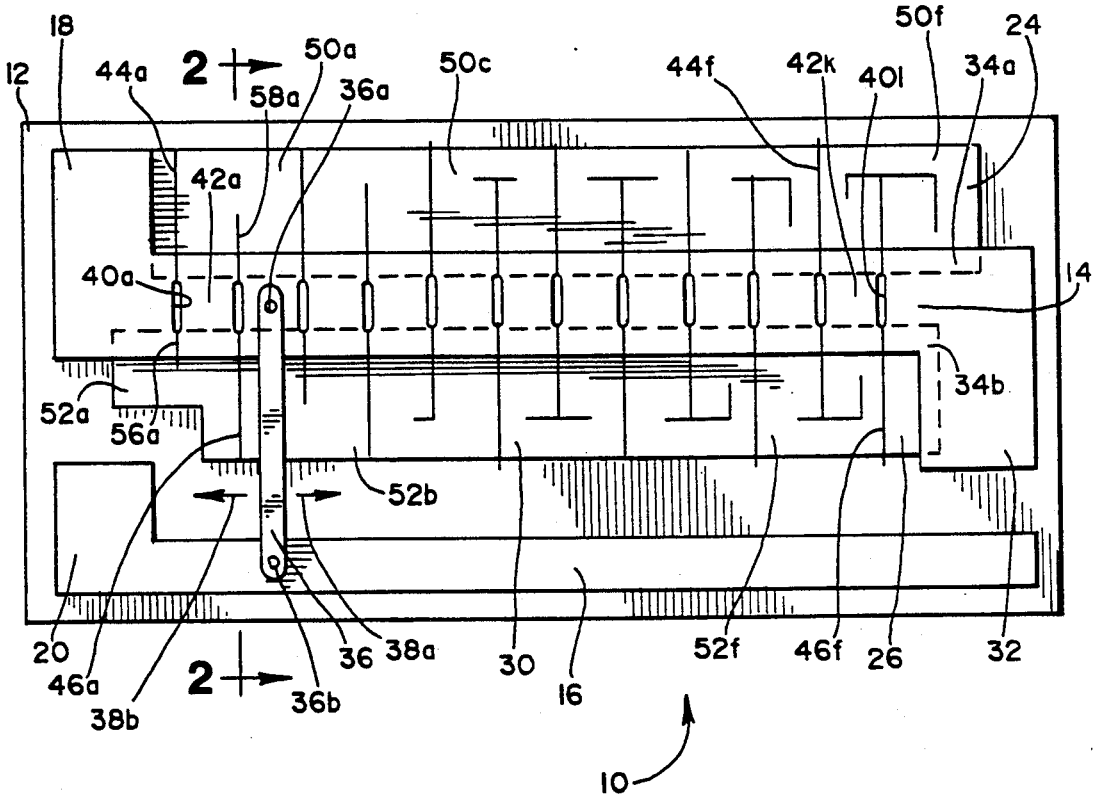
FIG. 1 is a top plan view of a linear resistive element using thick film technology.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 2:
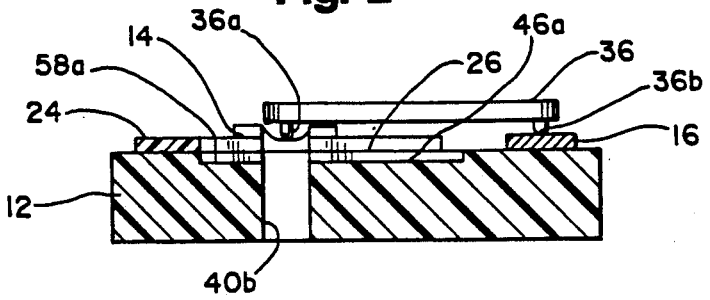
FIG. 2 is a sectional view taken along plane 2—2 of FIG. 1.

FIGS. 1 and 2 illustrate a linear potentiometer 10 which embodies the present invention. A substrate 12 which can be formed of $Al_2O_3$ carries first and second elongated spaced-apart conductors 14 and 16 thereon. Each of the conductors has an enlarged end region, 18 and 20 respectively. Each end region serves as a contact point or connection region to external circuitry.

The potentiometer 10 also includes first and second elongated layers 24 and 26 of resistive material. The layers 24 and 26 can be deposited either before or after the conductor conductive layers 14 and 16 have been deposited.

The method of depositing the resistive layers 24 and 26, while not a limitation of the present invention, can be by thick film deposition methods of a conventional nature. For example, conventional methods of thick film printing followed by subsequent firing of the layers can be used.

It is a particular advantage of the present invention that the layers 24 and 26 need not be deposited with high precision, nor with great uniformity, nor with precise geometry in order to achieve precise resistance values in the final product on the order of plus or minus 1% nominal or better. As a result, potentiometers, such as potentiometer 10, can be fabricated very inexpensively.

While the potentiometer 10 has been illustrated as having two spaced-apart elongated resistive layers 24 and 26 it will be understood that only one layer is necessary to form an operative device. Further, it will be understood that while the layers 24 and 26 have been illustrated as being formed of a continuously extending layer of the same type of resistive material, both layers 24 and 26 could be formed with two or more different types of resistive materials with one type being deposited starting adjacent to region 18 and region 20 and extending along the substrate 10 some predetermined distance to a region 30.

A second resistive material, of a higher resistivity can then be deposited starting from the vicinity of the region 30 extending to a distal end 32 of the conductive layer 14. The end region 32 is usable as a contact region to external circuitry and as a probe region during manufacturing.

It should also be noted that the conductive layer 14 and the resistive layers 24 and 26 overlap each other, in part, as in regions 34*a* and 34*b*.

A slider 36 is in electrical contact with the conductive layer 14 and the conductive layer 16. The slider 36 is movable axially on the substrate 12 in directions 38*a* and 38*b* respectively.

By moving the slider 36, the resistance of the potentiometer 10 between the contact or probe points 18 and 20 can be varied. The distal end region 32 of the region 14 provides a third electrical contact to the potentiometer 10 as is conventional.

After the film deposition process, the conductive layer 14 which is deposited as a continuously extending electrically conductive path is sliced by a group of centrally located slots 40*a*–40*l*. The slots 40*a*–40*l* could be cut by means of a computer controlled laser. These slots extend through the conductor 14 and either partially or completely through the substrate 12 in the region between the resistive layers 24 and 26.

The slots 40*a*–40*l* thus define a plurality of conductive segments 42*a*–42*k*. A contact region 36*a* slidably engages the regions 42*a*–42*k* as the slider 36 moves back and forth in the directions 38*a* or 38*b*. A second contact region 36*b* slidably engages the conductive layer 16.

The slots 40*a*–40*l* are cut either completely or partially through the base member 12 with a width on the order of 0.002 inches for the purpose of resisting migration of conductive material between segments. This migration is promoted by the movement of the contact region 36*a* from one segment, such as 42*a* across an intervening opening 40*b* onto the second segment 42*b*.

In a subsequent manufacturing step, a plurality of interruptions in the resistive layers 24 and 26, as well as the conductive layer 14 can be formed by a laser scribing operation. Slots or interruptions 44*a*–44*f* are associated with resistive layer 24. Slots 46*a*–46*f* are associated with the resistive layer 26. The laser scribed interruptions or slots 44*a*–44*f* and 46*a*–46*f* create a plurality of resistive elements such as resistive elements 50*a*–50*f* in the layer 24 and 52*a*–52*f* in the layer 26.

The resistive elements 50*a*–50*f* and 52*a*–52*f*, after appropriate adjustment, form highly precise resistor segments for the potentiometer 10. The adjustment of the resistive values 50*a*–50*f* and 52*a*–52*f* is accomplished using only two probes in contact with probe points 18 and 32 in combination with further laser scribing operations associated with each of the openings 40*a*–40*l*.

The resistive element 52*a* is adjusted to a predetermined precise value by laser scribing and forming an interruption 56*a* therein. The length of the interruption 56*a* produced by the laser scribing operation is determined by the desired resistance to be associated with region 52*a* which is read very readily and quickly via probe points 18 and 32.

Electrical conductivity exists between the element 42*a* and the distal end probe 32. Subsequent to forming the interruption 56*a*, the value of resistance element 50*a* can be adjusted by another laser scribing operation which forms an interruption 58*a*.

In this instance, the length of the scribed region 58*a* can be set by measuring between probe point 18 and distal end probe point 32 which results in an effective total resistance including the value of resistance of 52*a*, as previously trimmed, and the current value of resistive element 50*a* to be trimmed by formation of the scribed region 58*a*. Subsequently, each of the remaining resistor regions 52*b*–52*f* and 50*b*–50*f* can be trimmed in a laser scribing operation.

As illustrated in regions 50*c* and 52*f* by directing the laser scribe to form longer slices or slots in the respective element, the effective resistance of each respective element can be increased. Depending on the way in which the various respective laser scribing operations are carried out, the potentiometer 10 can be formed with a linear resistance characteristic, a logarithmic resistance characteristic or any other characteristic as resistance increases from region 52*a* through region 50*f*.

While the potentiometer 10 described above has been illustrated on a planar substrate 12, it will be understood that the substrate 12 could be curved or cylindrical without departing from the spirit and scope of the present invention.

While the resistive layers 24 and 26 have been illustrated in the potentiometer 10 as being elongated, generally rectangular in shape, it will be understood that other shapes can be used without departing from the spirit and scope of the present invention.

The potentiometer 10 is a very low noise device because the slider 36 makes contact on the deposited conductive layer 14 and not on either of the resistive layers 24 and 26. Further, by means of the laser scribing and the cuts 58*a* and 56*a* which are made in the deposited resistor regions 24 and 26, respectively, it is possible to vary the value of resistance from a minimum value to a maximum value of the potentiometer 10 over wide ranges while retaining the relatively simply geometry illustrated in FIG. 1.

Substantial variations in resistance of the potentiometer 10 can be readily achieved using standardized shapes of resistor elements such as 50*a* and 52*b* since the laser scribing operation can create convoluted electrical paths as illustrated in the resistive region 50*f*. This results in a very cost effective structure since the laser scribing operations can be computer controlled to achieve the desired resistance variations.

It will also be understood that various types of materials, such as an epoxy based printed circuit board can be used for the substrate 12. Another advantage of the potentiometer 10 is that it can be made quite small and it is very inexpensive and simple to fabricate.

With respect to FIG. 1, the first series of cuts 44*a*–44*f* using the laser delineates the individual resistor elements such as 50*a*–50*f*.

However, this slicing sequence leaves a continuous conductive path until the resistors are trimmed. Defining the resistors in this manner allows one to separate the resistors and conductor sections by 0.002". This separation distance is not achievable by printing. Therefore, with thick film processing, one gets the advantages of photolithographic dimensioning, this making pattern sizes comparable to smaller more expensive techniques without the difficult alignment. The present method also enables the use of only two probes to measure all resistance trim values further minimizing the areas needed.

The second series of cuts, such as cut 58*a* now trims the resistance value of each resistive element. By normal thick film processing and printing spacing one can not achieve a 2 MIL separation between elements as achieved by using 2 MIL laser cuts as here.

FIG. 3 illustrates a curved potentiometer 60. The potentiometer 60 is formed on a planar substrate 62 and includes a generally semi-circular conductive layer 64 having end, probe regions 66 and 68. The probe regions 66 and 68 correspond to the conventional end connector points to a potentiometer. A centrally located conductive region 70 deposited on the substrate 62 forms a central contact region for a rotatable slider member 71.

The potentiometer 60 also includes first and second spaced-apart curved resistive layers 72, 74, 76 and 78. The layers 72 and 76 are formed of the same resistivity material. The layers 74 and 78 are formed of a higher resistivity material.

As was the case with the linear potentiometer of FIG. 1, the arcuate conductive member 64 is interrupted via a plurality of slots, such as a slot 80 which extends partially or all the way through the substrate 62. Associated with each of the slots, such as the slot 80 is a laser scribed cut 82 on the order of two mils wide and which extends from an end of the opening 80 through the adjacent resistive layer 72.

A first resistive element 76*a* is trimmed to a precise resistance value using probe regions 66 and 68 respectively by a laser cut 84. As described previously with respect to the potentiometer 10, a plurality of subsequent laser scribed cuts, including cuts 84*a* and 84*b*, is formed in respective resistive layers 72 and 76 as well as layers 74 and 78. These cuts precisely trim the values of the respective resistive elements of the potentiometer 60 to plus or minus one percent of nominal or less.

The potentiometer 60 can be coupled to an adjacent electrical circuit by electrically coupling the circuit to end contacts 66 and 68 of the potentiometer as well as variable center contact 70 thereof.

Figure 5:
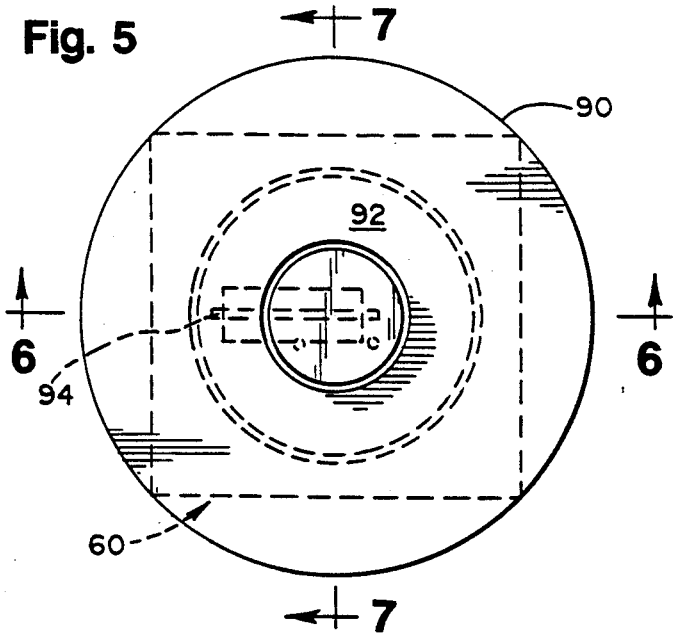
FIG. 5 is a top plan view of a housing usable with the resistive element of FIG. 3.
Figure 6:
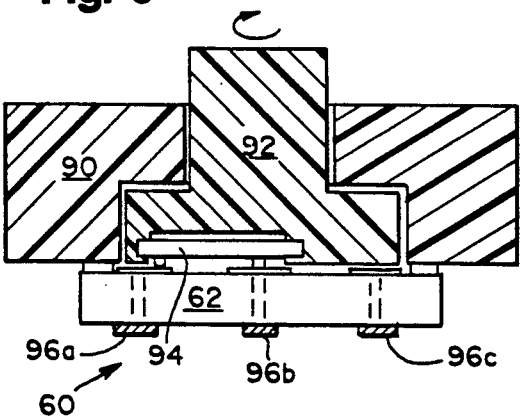
FIG. 6 is a side sectional view taken along plane 6—6 of FIG. 5.
Figure 7:
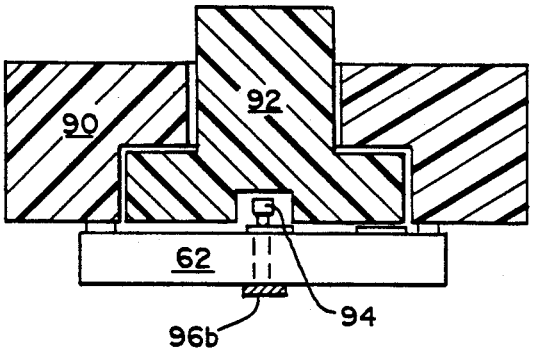
FIG. 7 is a side sectional view, perpendicular to the view of FIG. 6, taken along plane 7—7 of FIG. 5.

FIG. 5 illustrates the potentiometer 60 mounted in a generally cylindrical housing 90. The housing 90 has a rotatably mounted central region 92.

Rotating the region 92 rotates a wiper 94 of the potentiometer 60. Feed throughs 96*a*–96*c* can be used to electrically couple the end regions 66 and 68 as well as the wiper central region 70 to the associated electrical circuit.

The housing 90 can be attached to the substrate 60 via adhesive of any conventional variety. It will be understood that the exact shape of the housing 90 is not a limitation of the present invention.

The potentiometer 60 and associated housing 90 can be made very small physically and used in a variety of applications, such as hearing aids, where size is critical. The rotatable portion 92 of the housing 90 provides a mechanism for manually adjusting the setting of the potentiometer.

Figure 8:
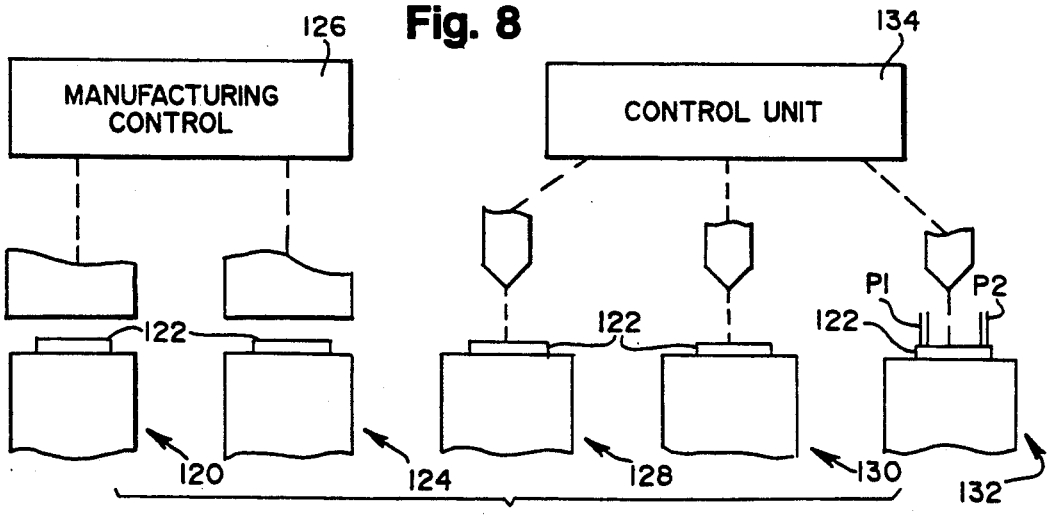
FIG. 8 is a schematic diagram illustrating the steps of manufacturing a resistive element in accordance with FIGS. 1–7.

FIG. 8 illustrates schematically a method of making a potentiometer such as the linear potentiometer 10 or rotary potentiometer 60. In an initial step, at a station 120, layers of conductive material are printed or otherwise deposited on a substrate 122. Depending on the type of deposition process, the station 120 may include a structure for firing or otherwise physically fixing the deposited conductive material onto the substrate 122.

In another step at a station 124, one or more layers of resistive material are deposited on the substrate 122. The resistive material may also be fired depending on the deposition process used. The deposition processes at stations 120 and 124 are carried out under the control of a manufacturing process control unit 126. Depending on the process used, the resistive material could be deposited first.

In a subsequent step, at station 128, the major spaced-apart slots, such as slots 40*a*–40*l* or slots 80 are cut into the deposited layers and either partially or completely through the substrate 122. The slotting operation is carried out using a relatively high powered laser cutting tool.

In a subsequent step, at a station 130, the first scribing operation is carried out on the unit. At this step, laser cuts are made into the resistive layers and portions of the conductive layers corresponding to slots 44*a*–44*f*.

At a final station 132, the values of various resistor segments, such as the resistor segment 50*a*, are trimmed using probes P1 and P2 and a laser cutting tool, which could be the same tool as used in station 130, for the purpose of precisely adjusting the effective value resistance of each of the segments. The various slottings, scribing operations of stations 128, 130 and 132 are carried out under the control of process control unit 134.

The processed element 122 can then be combined with a wiper contact and a housing. A linear or rotary potentiometer can be formed.

It will be understood that variations could be made to the above-described steps without departing from the spirit and scope of the present invention.

A resistive element can be formed using both sides of the substrate 62. In this embodiment, in addition to the conductive element 64 illustrated in FIG. 3 which is deposited on a first side of substrate 62, a second circular conductive element can be deposited on a second side of the substrate 62 displaced from the first side.

The conductive member 64 can be conductively connected to the deposited conductor on the second surface of the substrate 62 using vias or other forms of plated through holes. The second deposited conductive surface can be sliced into a plurality of isolated regions, corresponding to each of the regions of the member 64.

A wiper, such as the wiper 94, can be rotatably affixed to the second side of the substrate 62 for purposes of altering the resistance between an end region, such as the region 66 and the rotatable wiper. The advantage of this embodiment is that the wiper can contact a larger area for each of the segments.

In a further embodiment of the invention, precision electrical components can be formed with 2 mil spacing using printed thick film resistor and conductor elements. These structures and the related manufacturing process utilize relatively inexpensive thick film screening or printing processes for the deposition of resistive and conductive films. However, laser scribing is used to create 2 mil spaces between various resistive or conductive elements.

Further, the particular structure of the resulting resistive elements minimizes the effects of variations and the characteristics of the deposited resistive film. As a result, variations in the ohms/square parameter are no longer a significant factor.

The present resistor structure provides about a 20 to 1 aspect ratio. Increasing the height of the resistor above the conductor/resistor interface will increase the factor even more. As a result, the actual parameter value of ohm/square is no longer critical.

Figure 9:
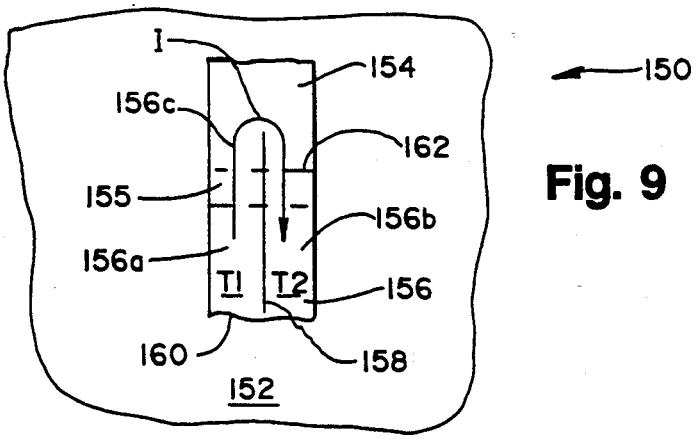
FIG. 9 is a top plan view of an individual resistive element in accordance with the present invention.

A resistive element 150 which embodies the present invention is illustrated in FIG. 9. The element 150 is formed and carried on an insulating substrate 152. The element 150 includes a deposited resistive region 154 and a deposited conductive region 156. The resistive region 154 and the conductive region 156 overlap one another in a region 155.

Typical sizes for the element 150 might be down to 25 mils long by 10 mils wide. It could be made down to 10×10 mils or best printing dimensions for the resistive element. The resistive layer 154 might have a resistance characteristics of 100 ohms per square.

In order to form the element 150, the continuously extending conductive layer 156 is sliced in half by a laser scribed line 158 which is initiated at an outer edge 160 of the conductor 156 and extends therethrough to an inner edge 162 which is adjacent to the resistive layer 154. As a result of this portion of the scribing operation the conductive layer 156 is now separated into two independent conductive regions **156*a* and 156*b*. These two regions form the input and output contact points or terminals for the resistive element 150**.

The laser scribed line 158 is then extended from the edge 162 into the layer of deposited resistive material 154 simultaneously with measuring the resistance between terminal **156*a* and terminal 156*b*. The laser scribed line 158 is extended as far as necessary into the deposited resistive layer 154 so as to produce the desired resistance between the terminals 156*a* and 156*b*. Current 156*c* will flow in the resistive element 150 from the terminal 156*a* to the terminal 156*b***.

It has been found, using a 100 ohm per square resistive material for the deposited layer 154 that a resistor of value 100 ohms can be obtained with the laser scribed cut 158 moving from the edge 162 into the resistive layer 154 on the order of 1 mil. To get a 500 ohm element the scribed line 158 extends into the resistive layer 154, from the edge 162 on the order of 7 mils.

Thus, the actual value of the ohms/square parameter for the deposited layer 154 is not critical. Similarly, the uniformity of the deposited material of the layer 154 is also not critical. The preciseness of the final value of the resistance element 150 is determined almost exclusively by the extent that the laser scribed line 158 extends into the layer 154 from the edge 162.

Figure 10:
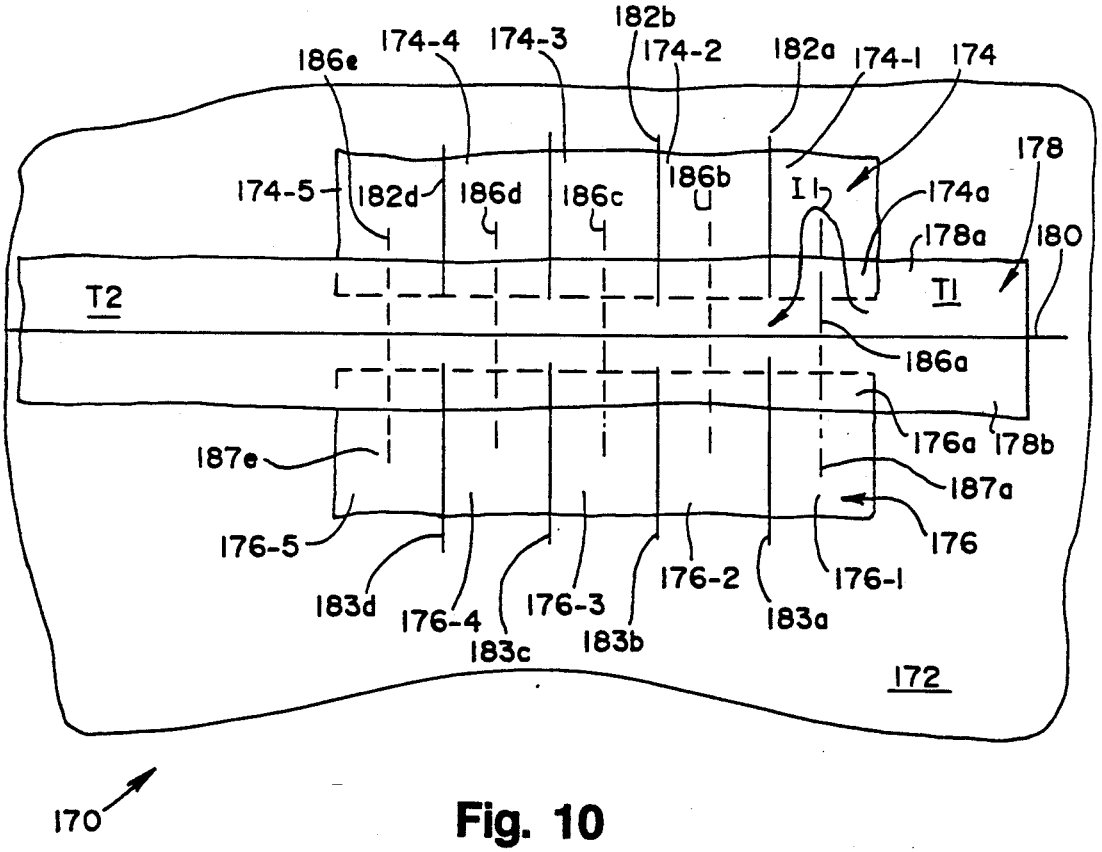
FIG. 10 is a top plan view of a plurality of interconnected resistors in accordance with the present invention.

A multi-element resistor structure 170 is illustrated in FIG. 10. The structure 170 incorporates the principles of the single resistor element 150 of FIG. 9.

The element 170 is carried on an insulating substrate 172. First and second continuously extending resistive layers 174 and 176 are deposited on the substrate 172.

A continuously extending conductive layer 178 is deposited on the substrate 172 in contact with portions **174*a* of the resistive layer 174 and portions 176*a* of the resistive layer 176. The deposited resistive material 174 can be the same as or different from the layer 176**.

An approximately 2 mil laser scribed line 180 extends axially through the continuous conductive layer 178 dividing it into two parts **178*a* and 178*b*. Additionally, a plurality of 2 mil laser scribed lines 182*a*–182*d* slice the continuously extending resistive region 174 into discrete resistors 174-1 to 174-5**.

The lines **182*a*–182*d* are substantially perpendicular to the line 180. As will be apparent subsequently, minor variations in the scribed lines 182*a*–182*d* will not affect the precision to which each of the resistors, such as the resistor 174-1**, can be trimmed.

The lines **182*a*–182*d* do not extend all the way to the line 180. Thus, a conductive path continues to exist between terminals T1 and T2. To trim resistor 174-1, while trim line 186*a* extends through the center line 180 to resistor 174-1, probes need only be placed on terminals T1 and T2. A plurality of additional trimming lines 186*b*–186*e* can be scribed onto each of the resistors 174-2 to 174-5**.

The resistive elements 174-1 to 174-5 are in series with one another and other elements of circuits can be interjected between these resistors as will be shown later.

Similar comments apply to scribed lines **183*a*–183*d* which separate resistance elements 176-1 to 176-5. Scribed trimming lines 187*a*–187*e*, precisely set the resistance values of each of 176-1 to 176-5**.

As was the case with the single resistive element 150 of FIG. 9, each of the discrete resistors, such as resistor 174-1 has its resistance value precisely determined by a laser scribed line **186*a* oriented generally perpendicular to the previously noted line 180. The extent that the line 186*a* extends into the part of the resistive layer 174 associated with the resistive element 174-1** determines the resistance value between terminal or contact regions T1 and T2.

A test current I1 will flow from Terminal T1 through resistor 174-1 to Terminal T2 while the line **186*a*** is being scribed. The scribing process will be terminated when the appropriate resistance value is reached.

Similar laser scribed lines, such as the line **186*b* in a resistive element 174-2 bounded by the scribed lines 182*a*, 182*b* adjust the resistance value. Each of the resistive elements 174-1 thru 174-5 is electrically coupled to the conductive portion 178*a*. Similarly, resistive elements 176-1 thru 176-5 are connected thru 178*b***.

In the event that it was desirable to have electrical access to one or more of the resistors of the structure 170, an embodiment illustrated in FIG. 11 could be used. A plurality of pads 202, 204, 206 could be deposited on the substrate 172. Wires such as wires **208*a*, 208*b* and 208*c* could be soldered or wire bonded in the case of gold wires between respective pads 202-206 and respective contact points 210*a*–210*c* on the conductive region 178*a***.

Thus, an electrical path between pad 202 and terminal T1 would include four resistors. Similarly, an electrical path between pad 204 and the terminal T1 would include three resistors.

Alternately, instead of establishing pads such as 202, 204 and 206, a plurality of conductors such as conductors **214*a*–214*e* can be directly coupled to terminals of an integrated circuit such as the integrated circuit 216. Depending where on the conductive region 178 the conductors 214*a*–214*e* were connected will determine the resistance coupled between various terminals of the integrated circuit 216**.

Yet another embodiment of the invention is illustrated in a structure 240 of FIG. 12. The structure 240 includes an insulating substrate 242 upon which has been deposited a continuously extending iced into a plurality of separate conducting members **244*a*–244*e* by means of a plurality of 2 mil laser scribed lines 246a–246d**.

As described previously with respect to resistive elements, the conductor structure 244 utilizes relatively inexpensive thick film deposition and printing techniques to create the continuously extending conductive region 244 in combination with precisely controllable laser scribed lines to create the plurality of separate conducting members which can be used to implement various electrical functions. The embodiment of FIG. 12 can be used in a variety of ways.

Figure 13:
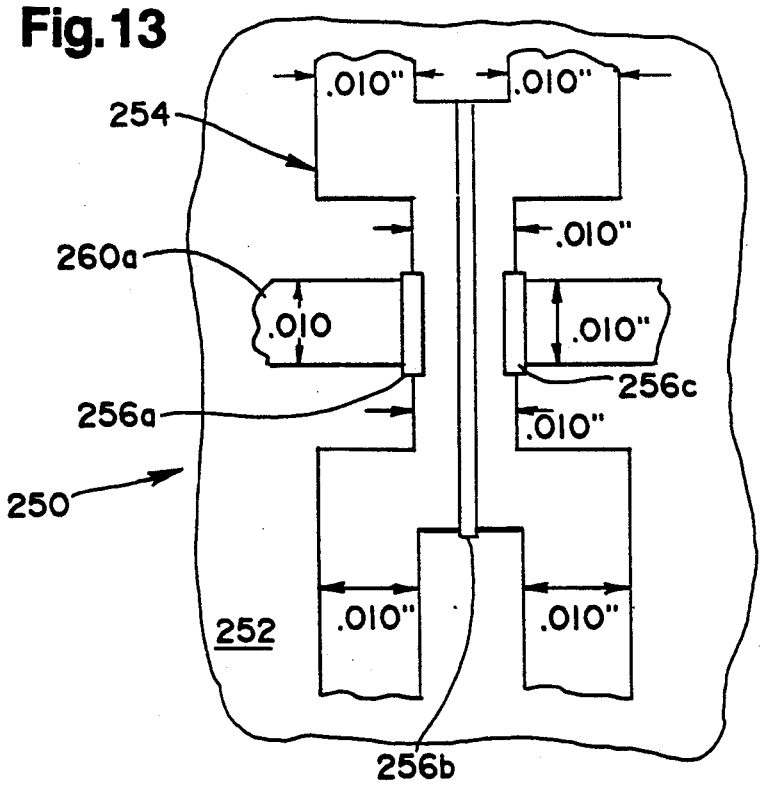
FIG. 13 is an enlarged top plan view of another group of conductive elements in accordance with the present invention.
Figure 14:
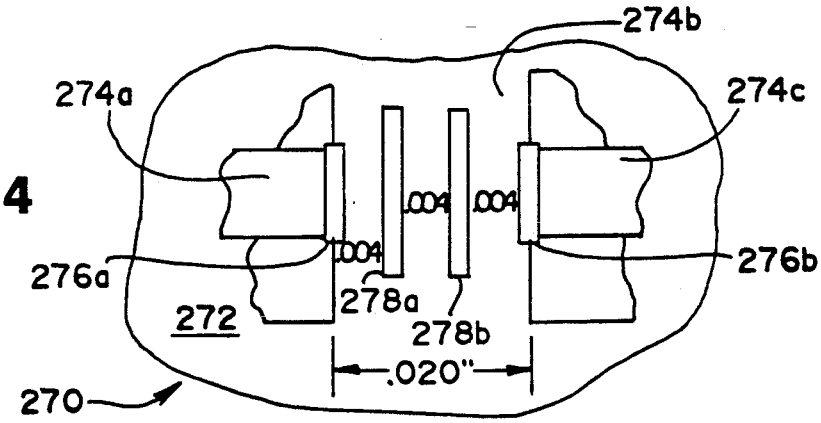
FIG. 14 illustrates yet another enlarged top plan view of conductive elements in accordance with the present invention.

The purpose of these structures in FIG. 13 and 14 is to show the ease with which one can run one or more conductive patterns between conductive lines (which cannot be done normally by printing). FIG. 13 and FIG. 14 illustrate, the space between conductors on a thick film printed substrate where, for example, a surface mounted capacitor would be attached. Without the laser trimming technique conductor lines would have to be routed around the elements and would take up much needed real estate.

FIG. 13 illustrates a more complex conductive structure 250 that can be created. The structure 250 is formed on a base member 252.

The structure 250 includes a deposited thick film conductive layer 254 of a selected arbitrary shape. The structure 254, after having been deposited, is transformed into a plurality of separate electrical structures by laser scribed lines 256a, 256b and 256c.

The structure 250 provides a solution to a need to print 10 mil lines, such as the conductive lines 260a and 260b which terminate with a 10 mil space therebetween and yet have a conductor extending through that 10 mil space. For example, a particular case may be the space between the soldered terminals of a surface mount Thick film deposition and printing techniques are unsuited for reliably locating a conducting member between the regions 260a and 260b. As a result of using the above describe approach, the cost advantages and ease of manufacturing obtainable with thick film deposition techniques are still retained.

However, since laser scribing can create two separate conductor lines between the spacings 256a, 256b and 256c within the 10 mil wide region, much space can be saved because the conductor lines do not have to be routed around the components. In practice, no conductor lines can be printed between the 0.010" space. For example, one line printed in a 10 mil space would require a 4 mil line with 3 mil spaces on both sides. This is very difficult to do with present technology.

Using the present approach of 10 mil lines and 10 mil spaces (readily available current technology), one can put not only one line but two lines thru this space. All that is required is three laser straight cuts.

An alternate embodiment, 270 is illustrated in FIG. 14. The embodiment 270 is formed with a substrate 272 upon which a conductive layer having regions 274a, 274b and 274c is formed. The regions 274a and 274c can be isolated from the region 274b by 2 mil laser scribed into three different conductors each having a width on the order of 4 mils by means of additional laser scribed lines 278a and 278b.

The structure 270 of FIG. 14 which illustrates three conductors safely and reliably passing through a 20 mil space far surpasses current levels of thick film technology which would enable only a single 7 mil conductor, with two 6½ mil spaces on each side thereof to pass through a 20 mil wide opening between two conductors such as the conductors 274a and 274c. This result can only be achieved by thick film printing with difficulty and with numerous inspections. In contradistinction, the structure of FIG. 14 can be created reliably and easily because of the high level of reliability of the results from using laser scribing to create the lines 276a, 276b, as well as the lines 278a and 278b.

Figure 15:
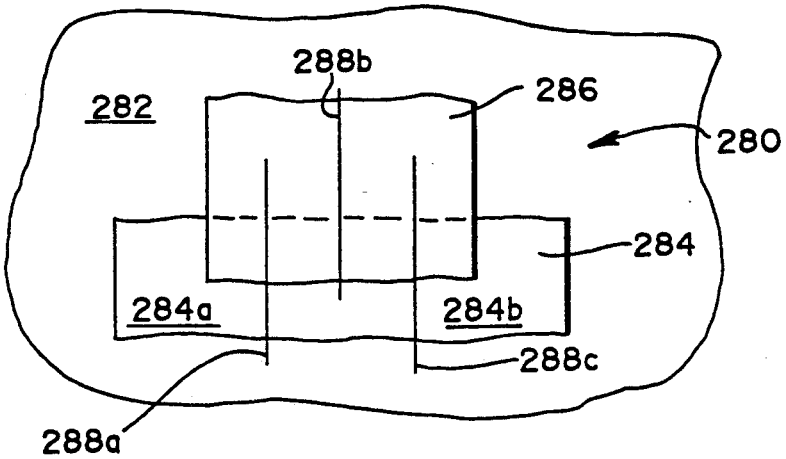
FIG. 15 is an enlarged top plan view of an alternate resistive element in accordance with the present invention.

Another resistor structure 280 is illustrated in FIG. 15. The resistor structure 280 is formed on a ceramic substrate 282 with a deposited conductor region 284. A deposited region of resistive material 286 partly overlays the conductor region 284.

The actual resistive value for the element 280 is set by laser generated trim lines 288a, 288b and 288c. Each of the trim lines 288a and 288c extends through the conductive layer 284 and into the resistive layer 286. The trim line 288b extends through the resistive layer 286 and partly into the conductor layer 284. As a result, a serpentine current path is generated between a first terminal region 284a and a second terminal region 284b.

The structure 280 has a very simple form. If a 250 ohm per square ink is used, then the structure 280 can be trimmed to values in a range between 200 ohms and 6,000 ohms. If a 300 ohm per square ink is used, the trim range falls between 250 ohms and 7200 ohms.

The very simple structure of the element 280 makes it very easy to deposit on a high density basis. Where a circuit has a large number of resistors, the element 280 can be replicated numerous times. In that instance, each of the resultant resistors would have the same general structure.

The resistor structure 280 like structure 150, is also advantageous in that the input/output conductor/resistor interface regions are all the same with respect to the current path. Thus, the structures 280 and 150 are unlike more complex shapes which affect resistance value due to conductor/resistor interface effects. The wide range of values to which the structures 280 and 150 may be trimmed means that many circuits will be implementable with only one and or two types of resistor structure.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

I claim:

1. A precision low power resistive element having a predetermined value comprising:

an insulating substrate;

a conductive layer deposited on a portion of said substrate;

a resistive layer deposited on a portion of said substrate with said two layers overlapping in part and with said conductive layer having first and second non-overlapping regions electrically separated from one another by at least one scribed non-conducting line extending across said conductive layer and into said resistive layer a predetermined amount thereby providing the predetermined resistive value between said regions.

2. A resistive element as in claim 1 with said conductive layer in part overlying said resistive layer.

3. A resistive element as in claim 1 with said layers each formed by a thick film deposition process.

4. A resistive element as in claim 1 with said scribed line being substantially straight 5. A resistive element as in claim 1 with said scribed line extending in part into said substrate.

6. A resistive element as in claim 5 with said layers each deposited by a thick film printing process.

7. A resistor formed of a plurality of series coupled resistive paths comprising:

an insulating base;

a continuously extending resistive layer on said base;

a continuously extending conducting layer on said base extending in contact with said resistive layer;

a first plurality of lines with each member of said plurality scribed through said resistive layer and partly into said conductive layer forming a plurality of discrete resistive elements;

a second plurality of lines with each member of said second plurality interspersed between a pair of adjacent lines of said first plurality and with each member of said second plurality extending across said conducting layer and in part into said resistive layer thereby forming one of the resistive paths.

8. A resistor as in claim 7 with each resistive path linked to at least one other resistive path by a portion of said conducting layer.

9. A resistor as in claim 7 including an input terminal and an output terminal.

10. A resistor as in claim 7 including means for coupling to at least some of said resistive elements.

11. A resistor as in claim 7 including:

a second continuously extending resistive layer on said base;

a second continuously extending conducting layer on said base extending in contact with said second resistive layer;

a third plurality of lines with each member of said plurality scribed through said second resistive layer and partly into said second conductive layer forming a plurality of discrete resistive elements;

a fourth plurality of lines with each member of said fourth plurality interspersed between a pair of adjacent lines of said third plurality, and, with each member of said fourth plurality extending across said second conducting layer and in part into said second resistive layer thereby forming one of the resistive paths.

* * * * *

UNITED STATES PATENT AND TRADEMARK OFFICE

CERTIFICATE OF CORRECTION

PATENT NO. : 5,148,143

DATED : September 15, 1992

INVENTOR(S) : B. Greenstein

It is certified that error appears in the above-identified patent and that said Letters Patent is hereby corrected as shown below:

Column 12, line 67, after "extending", please delete --iced-- and insert --conductive layer 244. The conductive layer 244 can be sliced--.

Column 13, line 35, after "surface mount", please insert --capacitor--.

Column 13, lines 59-60, after "scribed", please insert --lines 276a and 276b. The region 274 can be subdivided--.

Column 14, line 33, after the word "280", please insert a comma.

Col. 15,
Claim 4, line 2, after "straight", please insert a period.

Signed and Sealed this

Ninth Day of November, 1993

*Attest:*

*Attesting Officer*

Bruce Lehman

BRUCE LEHMAN

*Commissioner of Patents and Trademarks*